US005877683A

United States Patent [19]

Sheasley

[11] Patent Number: 5,877,683

[45] Date of Patent: Mar. 2, 1999

[54] HOME ALARM SYSTEM

[76] Inventor: Eldon W. Sheasley, 4801 Proctor Oaks Ct., Sarasota, Fla. 34233

[21] Appl. No.: 85,073

[22] Filed: May 26, 1998

[51] Int. Cl.[6] ..... G08B 29/00

[52] U.S. Cl. ..... 340/506; 340/527; 340/541; 379/39; 379/44

[58] Field of Search ..... 340/506, 526, 340/528, 531, 539, 541, 825.06, 825.32, 825.36, 309.15; 379/39–45

[56] References Cited

U.S. PATENT DOCUMENTS

| | | | |
|---|---|---|---|
| 3,797,006 | 3/1974 | Reininger | 340/530 |
| 3,803,576 | 4/1974 | Dobrzanski et al. | 340/428 |
| 4,114,147 | 9/1978 | Hile | 340/428 |
| 4,148,019 | 4/1979 | Durkee | 340/531 |
| 4,257,038 | 3/1981 | Rounds et al. | 340/539 |
| 4,492,820 | 1/1985 | Kennard et al. | 179/5 |
| 4,551,832 | 11/1985 | Carll et al. | 370/58 |
| 4,742,327 | 5/1988 | Burgess et al. | 340/426 |
| 4,755,792 | 7/1988 | Pezzolo et al. | 340/538 |
| 4,760,393 | 7/1988 | Mauch | 340/825.31 |
| 5,138,299 | 8/1992 | Patten et al. | 340/545 |
| 5,235,320 | 8/1993 | Romano | 340/539 |
| 5,434,556 | 7/1995 | Donohoo | 340/547 |
| 5,497,149 | 3/1996 | Fast | 340/988 |
| 5,574,425 | 11/1996 | Shu | 340/426 |

*Primary Examiner*—Jeffery A. Hofsass
*Assistant Examiner*—Daryl C. Pope
*Attorney, Agent, or Firm*—Charles J. Prescott

[57] ABSTRACT

A home alarm system for use by an authorized user while in the home, manual input commands to the system being required by the user as events around the home might occur for proper system operation. The system includes a programmable microcomputer having a specific preprogrammed operating logic and a multi-key control panel operably connected to the microcomputer. By manually depressing an arming key, the microcomputer is activated to initiate a first time delay. This would typically be done by a user at the ring of a doorbell or upon hearing strange noises and the like. Unless a multi-key disarming code is entered before the end of the first timing delay, a warning signal is activated and continues for a second preprogrammed time delay. Again, unless the disarm code is timely entered before the end of the second time delay, a very loud siren or other wide area broadcast alarm signal is activated. A remote control unit is also provided for instant alarm signal activation, along with an automatic emergency phone number dialer which is activated when the alarm signal is activated.

4 Claims, 2 Drawing Sheets

HOME ALARM SYSTEM

BACKGROUND OF THE INVENTION

SCOPE OF INVENTION

This invention relates generally to alarm systems, and more particularly to a home alarm system activated while one or more of the users are in residence within the home at a time of need.

PRIOR ART

Prior art is crowded with patented alarm systems for homes, vehicles, businesses and the like. Many of these prior art systems utilize one or more sensors which are activated when there is unauthorized entry into the protected area. These systems are typically active at all times so that, when the premises or vehicle is left unattended, an alarm will be broadcast widely to advise individuals in the vicinity and/or a police monitoring service of an unauthorized breaking and/or entry.

The following of these prior art patents known to applicant are as follows:

| Pat. No. | Inventor | Title |
|---|---|---|
| 5,574,425 | Shu | Anti-Hijacking Safety System |
| 5,434,556 | Donohoo | Magnetic Door Alarm |
| 5,235,320 | Romano | Alarm System |
| 5,138,299 | Pallen et al. | Showcase Alarm System |
| 4,760,393 | Mauch | Security Entry System |
| 4,755,792 | Pezzolo et al. | Security Control System |
| 4,742,327 | Burgess et al. | Keyless Access Control & Security System |
| 4,257,038 | Rounds et al. | Coded Security System |
| 4,114,147 | Hile | Code Combination Property Alarm System |
| 3,803,576 | Dbrzanski et al. | Residential Alarm System |
| 3,797,006 | Reininger | Safety Alarm System and Switch |

Particularly noteworthy in this body of prior art is the '299 patent to Patten which discloses a security system for protecting a display showcase. To enter the showcase, a clerk must first trigger a locked switch which may be either key activated or electronic keypad activated to activate a timer. The clerk may then open the door to access the showcase for a preset amount of time. If the door to the showcase is not closed by the expiration of this time period, an alarm will be activated.

Hile, in the '147 above-referenced patent discloses a property protection alarm which is armed by entering the code into the keyboard thereof. The alarm system then provides an exit delay time period for the homeowner or user to exit the home and close the door. Upon reentering the door, an entrance delay will provide sufficient time for the user to enter the home and then enter a preprogrammed code into the keyboard. If the code is not timely entered, an alarm signal will be activated and widely broadcast.

The remaining of the above-referenced U.S. patents are representative of the broad range of alarm system technology. However, it is submitted that none of the prior art devices, either individually or collectively, disclose the unique features of the present invention which teaches and claims a home alarm system manually activated while the user is and remains inside of the home at the occurrence of either a door knock, a doorbell ring, or other strange noise indicating possible unauthorized breaking or entry. Two separate time delays are provided which are manually controlled and activated sequentially by a user so that, unless a follow-up disarm code is entered, a wide ranging alarm such as a siren or other visible indicia is activated for broadcast to the area surrounding the home without further user interaction with the system.

BRIEF SUMMARY OF THE INVENTION

This invention is directed to a home alarm system for use by an authorized user while in the home, manual input commands to the system being required by the user as events around the home might occur for proper system operation. The system includes a programmable microcomputer having a specific preprogrammed operating logic and a multi-key control panel operably connected to the microcomputer. By manually depressing an arming key, the microcomputer is activated to initiate a first time delay. This would typically be done by a user at the ring of a doorbell or upon hearing strange noises and the like. Unless a multi-key disarming code is entered before the end of the first timing delay, a warning signal is activated and continues for a second preprogrammed time delay. Again, unless the disarm code is timely entered before the end of the second time delay, a very loud siren or other wide area broadcast alarm signal is activated. A remote control unit is also provided for instant alarm signal activation, along with an automatic emergency phone number dialer which is activated when the alarm signal is activated.

It is therefore an object of this invention to provide a home invasion alarm circuit to protect the user(s) of the system while in residence within the home.

It is yet another object of this invention to provide an easily armed home invasion/alarm system upon a user in residence within the home hearing a visitor at the door or other strange sounds suggesting unauthorized entry attempt.

It is still another object of this invention to provide a home alarm system having a sequence of events including preprogrammed sequentially activated time delays and audible or viewable indicia of the current status of the alarm system ultimately leading to the activation of a broad area broadcast alarm unit if the user does not take appropriate steps to interrupt the preprogrammed sequence of time delay events leading to the alarm unit activation.

It is yet further another object of this invention to provide an alarm system which will protect individuals within the home rather than being designed only to provide a property security system.

In accordance with these and other objects which will become apparent hereinafter, the instant invention will now be described with reference to the accompanying drawings.

DETAILED DESCRIPTION OF THE INVENTION

Figure 1:
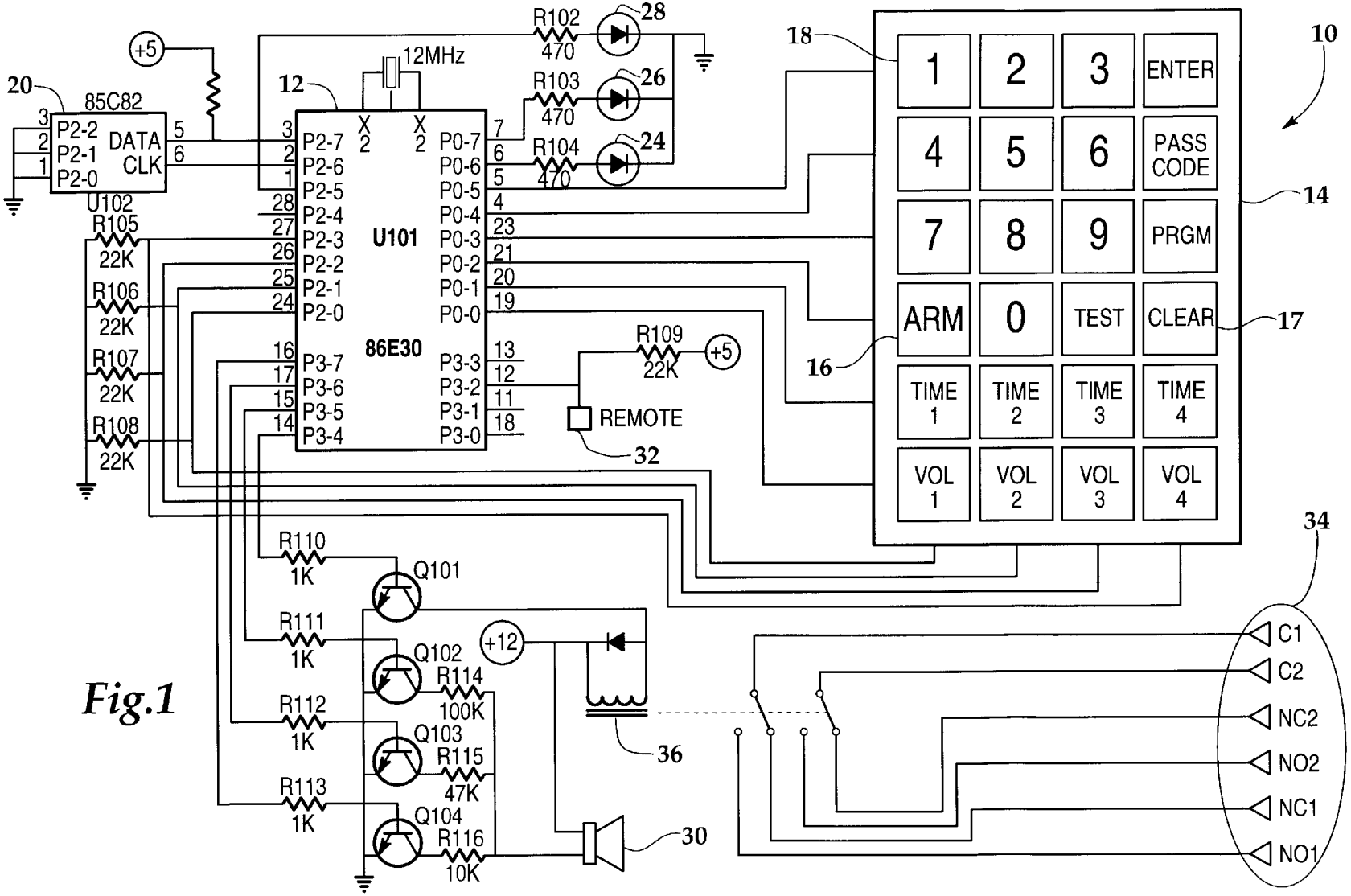
FIG. 1 is a is an electronic schematic diagram of the preferred embodiment of the system.

Referring now to the drawings, the heart of the DOOR MASTER system, which is shown in FIG. 1 generally at numeral 10, is the single-chip microcomputer 12 (U101). This microcomputer 12 is augmented by a 256 byte EEPROM memory device 20 which provides nonvolatile memory storage for the user pass code as well as alarm sequence time and volume values. The serially addressed EEPROM memory device 20 is connected to pins 2 and 3 of the microcomputer 12 to provide data transfer and synchronizing clock signals.

A multi-key control panel 14 is monitored via a continuous scanning aspect of the system 10 which sequentially outputs a logic high (+5) signal on the keypad rows 1–6 on (U101) pins 4, 5, 19, 20, 21 and 23. At each step of this sequence, the keypad columns are tested for key closure at U101, pins 24–27. Any key closure will complete the circuit from the row to column key scans by the microcomputer 12 on the keyboard array. Detected key closures are qualified by a debounce time prior to processing. Column pull-down resistors R105–R108 provide a zero volt reference at pins 24–27 in the absence of a key input.

Tone signal outputs are generated by U101 at pins 15, 16 and 17. These outputs are toggled on and off in unison at a 500 Hz or 1000 Hz rate, depending upon the type of signal being generated. The combination of outputs which are toggled determines the volume of the tone sounded in the system speaker 26. The signal at pins 15, 16 and 17 is current-limited by R111, R112 and R113 and fed to the base of transistors Q102, Q103 and Q104. A high level at these output pins turns on the corresponding transistor to saturation. Resistors R114, R115 and R116 at the collector of the transistors results in current flow from the +12 volt power supply through the signaling speaker 30.

An external alarm relay 36 is driven by transistor Q101. Base current to this transistor is provided through R110 by the microcomputer 12 at pin 14. When the signal at this pin goes high, Q101 is turned on which energizes the relay 36 to activate external alarm or auto-dialer functions via output terminals encircled at 34 (described below).

Microcomputer pins 1, 6 and 7 provide current which is limited by R102, R103 and R104 to illuminate the three panel indicator LEDs 24, 26 and 28. During all phases of operation, including standby, one or more of these LEDs are illuminated or blinking. A manually operated remote control unit 32 is connected to microcomputer 12 at pin 12. A low signal at this point will immediately sound the Door Master alarm 26 and activate any external alarm circuits.

All of the system's logical and functional operations are controlled by the programmable microcomputer 12. The main functional programmed elements are: (a) keypad input monitoring; (b) signal tone generation; (c) process timing and control; (d) program entry, storage and retrieval.

The keypad or control panel 14 is continuously monitored for user input. The only keys which are active in the normal operating mode are the ARM and CLEAR keys 16 and 17, along with keys 0–9. The other keys are ignored unless the unit is in the programming mode which is indicated by a steady amber LED 26.

Pressing the ARM key 16 under any condition will activate the system 10 alarm operating sequence of system 10. This warning and alarm sequence is described in detail herebelow. The only way to abort an alarm sequence is to enter the correct multi-key pass code digit sequence on the keypad.

PASS CODE

The pass code may be any user-programmable number from one (1) to fifteen (15) digits, each digit ranging from 0 through 9. The system 10 continuously monitors keypad input for a match between the entered digits and the stored pass code digit sequence. In order for a match to be valid, not only the particular digit sequence, but also the exact number of digits entered must match the stored pass code. If an error is made in the digit entry process, the CLEAR key 17 must be pressed and the digit sequence re-entered from the beginning. This feature adds a significant safeguard against unauthorized random-key discovery of the user's pass code.

When a valid pass code is entered, two events occur: any pending alarm sequence or time delay is terminated without qualification, and the user is allowed to press the PRGM key (immediately following) to enter the unit's programming mode. The programming mode, however, is safeguarded by a 'time-delay' function which inhibits access to the programming features of the device within thirty (30) minutes of either the ARM key 16 being pressed or power being applied, whether at initial installation or after a power supply interruption. The mechanical design of the keypad 14 is such that it provides tactile feedback, both mechanically and aurally, that a key 18 is being pressed.

PROCESS TIMING AND CONTROL

The microcomputer 12 is clocked by a 12 MHz ceramic resonator. An internal time base interrupt is generated every 500 microseconds. This provides 2,000 interrupts per second. This time interval is used to key the tone signal outputs and is divided down to count seconds and minutes. These various time intervals (described herebelow) are utilized to operate and sequence all of the timing functions of the system 10.

In normal standby (ready) mode, the GREEN LED 28 will blink once every second. When the ARM key 16 is pressed, the RED LED 26 turns on to indicate that the system 10 has been armed. During this time the GREEN LED 28 will remain off and the AMBER LED 24 will blink once every second. The AMBER LED 24 will continue to blink once per second until thirty minutes have passed since the unit has been armed.

ALARM SEQUENCE

As soon as the ARM key 16 is pressed, the alarm sequence (described more fully below) begins. This is indicated by the RED LED 26 as well as coded beep tone signals at speaker 30. The ARM key 16 is active at all times, including program lockout periods and when in the programming mode. The alarm sequence is divided into four distinct stages, each with its own unique aural signal. The time duration of each stage is individually programmable as is the volume level of the audio signal for each stage.

The first stage, ARMED, is indicated by a short 500 Hz beep every second at speaker 30. This is simply a reminder that the system alarm sequence has been manually user activated.

The second stage 'WARN' is accompanied by a brief 1000 Hz beep at 30 every second. This indicates that a first "armed" time period has expired.

A 'PRE-ALARM' is a preferred, not required, third stage and is signaled by five 1000 Hz beeps at 30 every second. This signal indicates that the triggering of external alarm circuits at 34 (external alarms and broadcast signaling devices not shown) is imminent.

The final 'ALARM' stage is signaled by a long 1000 Hz beep at 30 every second. This is the stage during which external alarm circuits are activated at outputs 34. Entering the correct pass code at any point in this sequence, including the ALARM stage, will terminate the alarm.

PROGRAM ENTRY, STORAGE AND RETRIEVAL

Access to the programming mode is gained by entering the correct pass code and then pressing the PRGM key. When the programming mode is active, the AMBER LED 24 will remain on continuously. The programming session is terminated by pressing the PRGM then CLEAR keys. If there is no keypad activity for over four (4) minutes, the unit will automatically exit the programming mode. A programming session will also be aborted if the ARM key 16 is pressed.

The programming mode may not be accessed within thirty (30) minutes after power is applied (initially or following a power interruption) nor within thirty (30) minutes of the system 10 having been armed. This time-delay lockout is to safeguard against program modifications by unauthorized persons. When the programming mode is time-locked out, the AMBER LED 24 will blink one time per second.

PASS CODE

A new pass code in entered by pressing the PASS CODE key, then the new code sequence (from 1 to 15 digits) and then the ENTER key. The new pass code takes effect immediately.

STAGE TIMING

Timing for each stage is selected by pressing the appropriate TIME key followed by one, two, or three digits corresponding to the desired time period in seconds, and then pressing the ENTER key. The range of valid values for each stage is from 1 to 250 seconds.

SIGNAL VOLUME

The volume level of the signal beeps at speaker 30 for each stage may be set to any value from 0 (silent) to 7 (loudest). Levels are set by pressing the appropriate Volume key followed by a digit key from 0 to 7. Since all volume settings are single-digit numbers, the ENTER key is not used for this function.

Whenever a new value is entered for a stage timing or volume, that stage is simulated at the new time/volume settings. The unit will stop sequencing at the end of the test stage and will not advance to the next stage. This provides the user with immediate feedback regarding the newly selected settings. Pressing the CLEAR key during this test stage will terminate the test.

Figure 2:
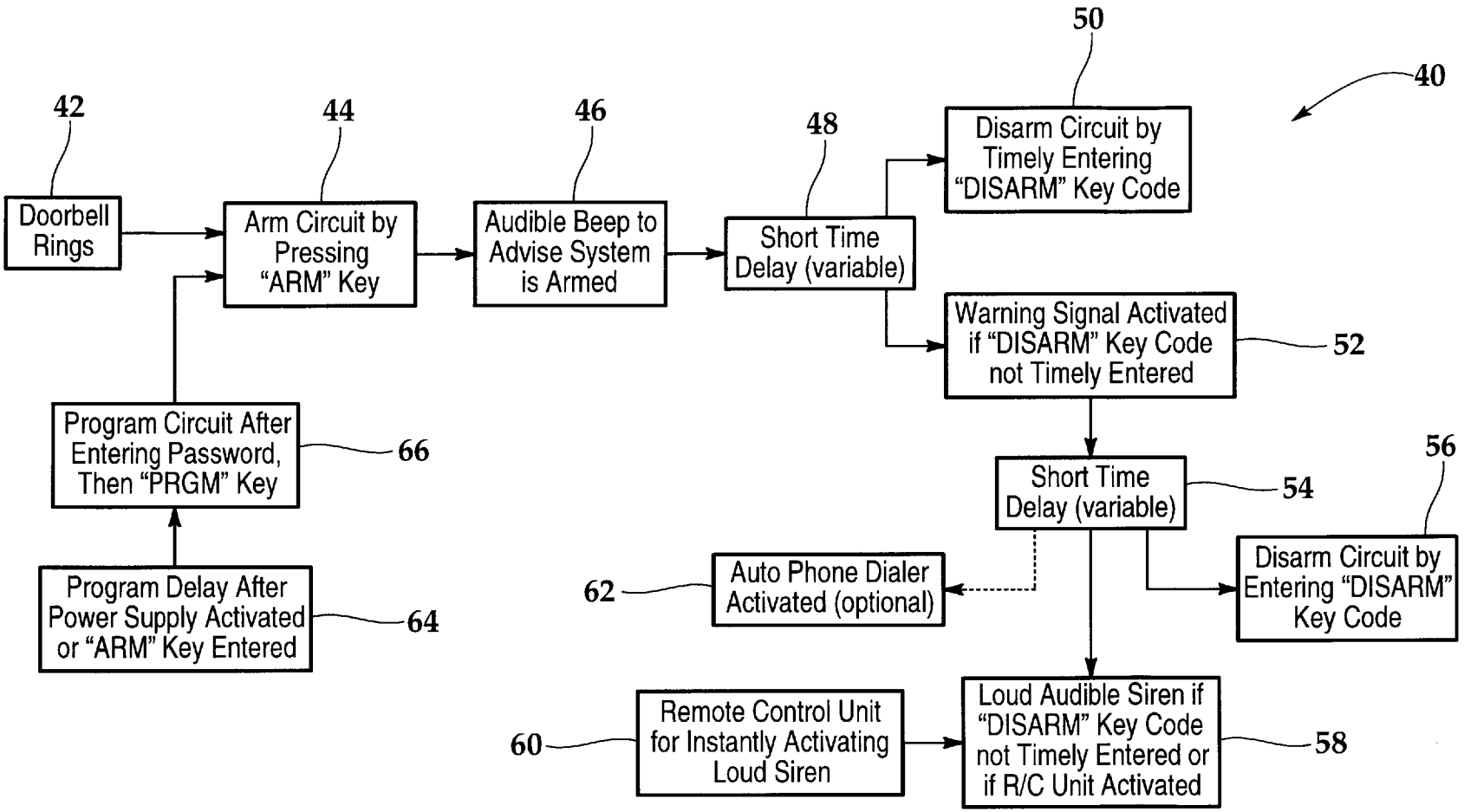
FIG. 2 is a is a block diagram showing the sequence of events preprogrammed within the system shown in FIG. 1.

Referring now additionally to FIG. 2, a block diagram of the operation of the system is there shown generally at numeral 40. While on standby, should a person outside of the home in which the system is installed were to, for example, ring the doorbell of the home at 42, a user inside of the home would immediately depress the "arm" key 16 of FIG. 1 as shown at 44. At audible beep is sounded to advise the user that the system has been armed at 46 by having pressed the arm key 44. The user would then go to the door and either open the door or through a sight glass determine the identity of the visitor.

The user has a short time delay at 48 after having armed the system to identify the visitor and then take appropriate action as follows. If the visitor is welcome, the user would disarm the circuit at 50 by pressing the disarm key code. This disarm code, again, is a multi-key code of up to 15 digits which must be correctly sequentially entered into the keypad 14 in FIG. 1.

However, should the disarm code not be entered before the end of the first time delay period, a warning signal will be activated at 52 to advise the user that a second time delay period at 54 has been initiated. Again, the second time delay period at 54 may be varied in the preprogramming mode for up to 250 seconds.

During the second time delay period 54, the user may again disarm the circuit at 56 by entering the multi-key disarm code. Should the user fail to timely enter the disarm code at 56, a loud audible siren or other external visible or audible alarm will be activated by the system at system outputs 34 shown in FIG. 1. This loud audible siren at 58 is intended to alert surrounding neighbors and individuals in the vicinity of the home being protected that a distress situation has occurred at the protected home. Note the preferred pre-alarm stage previously described.

Optionally and preferably, an auto phone dialer may be activated at 62 at the end of the second time delay period at 54 in addition to triggering the alarm siren at 58. The distress phone number programmed into the auto dialer is variable according to user desires.

There are other circumstances in which a user within the home might encounter an intruder attempting to break into the home. A remote control unit at 60 is also provided which can be positioned in any other room of the house which, when manually activated, will instantly cause the system 10 to activate the audible siren at 58. As previously described, at the initialization of the system or after an electrical power interruption, the microprocessor 12 of the system 10 in FIG. 1 is provided with a program delay at 64 in FIG. 2 to prevent reprogramming or altering of the preprogrammed stored information for a time period of approximately 30 minutes. After the mandatory delay in either of these circumstances, the program circuit may be accessed at 66 for entering a new password and then depressing the "PROGRAM" key thereafter.

Having fully disclosed and described this system 10 and its programmed logic 40, it should be clear that the system is personal to the user(s), requiring only manual user input to effect system arming and disarming at limited time periods.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A home alarm system comprising:

a logic and data storing microcomputer including a multi-key control panel operably connected to said microcomputer;

a manually activated key pad arming means operably connected to said microcomputer for starting a first preselected time delay and for activating a corresponding advisory indicia to advise the user that said first time delay has been initiated;

a coded disarm means manually activated by entering a coded series of preselected key pads of said control panel for terminating said first time delay prior to an end thereof;

a warning signal means activated by said microcomputer for providing a corresponding advisory warning signal that said disarm means has not been manually activated and that said first time delay has ended;

a means within said microcomputer for starting a second preselected time delay, said disarm means also for manually terminating said second time delay prior to an end thereof;

a wide area broadcast audible or visible alarm signal unit operably connected to a first output signal of said microcomputer, said first output signal activating said alarm signal unit to alert those in the vicinity of the house after the end of said second time delay of a potential distress situation;

said disarm means further for manually terminating said first output signal and said alarm signal unit;

a manually operated remote control means positionable a distance from, and in operable communication with, an input of said microcomputer for immediately activating said alarm signal unit.

2. A home alarm system as set forth in claim 1, further comprising:

an automatic phone dialer operably connected to a second output signal of said microcomputer which dials a preselected emergency phone number substantially simultaneously with activation of said alarm signal unit by said first output signal.

3. A home alarm system comprising:

a logic and data storing microcomputer including a multi-key control panel operably connected to said microcomputer;

a manually activated key pad arming key of said control panel for starting a first preselected time delay within said microcomputer and for activating a corresponding advisory indicia to advise the user that said first time delay has been initiated;

a preprogrammed disarm code in said microcomputer which is manually activated by entering said disarm code by depressing selected key pads of said control panel corresponding to said disarm code for terminating said first time delay prior to an end thereof;

a warning signal automatically activated by said microcomputer for providing a corresponding advisory warning signal to the user that said disarm code has not been manually timely activated and that said first time delay has ended;

said microcomputer further including a second preselected time delay which is automatically activated after said warning signal is activated, said disarm code also for manually terminating said second time delay prior to an end thereof;

a wide area broadcast audible or visible alarm signal unit operably connected to a first output signal of said microcomputer, said first output signal activating said alarm signal unit to alert those in the vicinity of the house after the end of said second time delay of a potential distress situation;

said disarm code further for manually terminating said first output signal and said alarm signal unit;

a manually operated remote control unit positionable a distance from, and in operable communication with, an input of said microcomputer which immediately activates said alarm signal unit when manually activated.

4. A home alarm system as set forth in claim 3, further comprising:

an automatic phone dialer operably connected to a second output signal of said microcomputer which dials a preselected emergency phone number substantially simultaneously with activation of said alarm signal unit by said first output signal.

* * * * *